US009427132B2

(12) United States Patent
Boyer et al.

(10) Patent No.: US 9,427,132 B2
(45) Date of Patent: Aug. 30, 2016

(54) SPRAY ASSEMBLY FOR A DISHWASHER APPLIANCE

(71) Applicant: General Electric Company, Schenectady, NY (US)

(72) Inventors: Joel Charles Boyer, Louisville, KY (US); Errin Whitney Gnadinger, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 637 days.

(21) Appl. No.: 13/737,195

(22) Filed: Jan. 9, 2013

(65) Prior Publication Data

US 2014/0190533 A1 Jul. 10, 2014

(51) Int. Cl.
*A47L 15/23* (2006.01)
*A47L 15/42* (2006.01)

(52) U.S. Cl.
CPC ..... *A47L 15/23* (2013.01); *A47L 15/42* (2013.01); *Y10T 29/49826* (2015.01)

(58) Field of Classification Search
None
See application file for complete search history.

(56) References Cited

U.S. PATENT DOCUMENTS

| | | | | | |
|---|---|---|---|---|---|
| 5,211,190 | A * | 5/1993 | Johnson | A47L 15/23 | 134/180 |
| 5,427,129 | A * | 6/1995 | Young, Jr. | A47L 15/23 | 134/176 |
| 5,477,874 | A * | 12/1995 | Yura | A47L 15/23 | 134/105 |
| 5,609,174 | A * | 3/1997 | Ferguson | A47L 15/23 | 134/180 |
| 5,752,533 | A | 5/1998 | Edwards | | |
| 2009/0145981 | A1* | 6/2009 | Mack | A47L 15/23 | 239/261 |
| 2010/0043826 | A1* | 2/2010 | Bertsch | A47L 15/4221 | 134/18 |
| 2012/0279534 | A1* | 11/2012 | Boyer | A47L 15/23 | 134/198 |
| 2013/0206179 | A1* | 8/2013 | Watson | A47L 15/428 | 134/25.2 |

FOREIGN PATENT DOCUMENTS

| | | | | |
|---|---|---|---|---|
| DE | 198 12 329 C1 | 6/1999 | | |
| DE | 19812329 C1 * | 6/1999 | ..... | A47L 15/23 |

* cited by examiner

*Primary Examiner* — Michael Barr
*Assistant Examiner* — Cristi Tate-Sims
(74) *Attorney, Agent, or Firm* — Dority & Manning, P.A.

(57) ABSTRACT

The present subject matter provides a spray assembly for a dishwasher appliance. The spray assembly includes a spray arm, a bearing, and a bracket for mounting the spray assembly to a dishwasher appliance. The spray arm is mounted for rotation relative to the bearing, and the bearing is mounted to the bracket. The spray assembly includes features for rotating the bearing relative to the bracket with the spray arm. Such rotation can assist with mounting of the bearing to the bracket.

19 Claims, 9 Drawing Sheets

SPRAY ASSEMBLY FOR A DISHWASHER APPLIANCE

FIELD OF THE INVENTION

The present subject matter relates generally to dishwasher appliances and spray assemblies for the same.

BACKGROUND OF THE INVENTION

Dishwasher appliances generally include a tub that defines a wash compartment. Rack assemblies are mounted within the wash compartment and are configured for receipt of articles for washing. Spray assemblies are also mounted within the wash compartment and can apply wash fluid to articles within the rack assemblies during operation of the dishwasher appliance. The spray assemblies can include a lower spray assembly directly or indirectly mounted to the tub at a bottom of the wash compartment, a mid-level spray assembly mounted to one of the rack assemblies, and an upper spray assembly directly or indirectly mounted to the tub at a top of the wash compartment.

The spray assemblies can each include spray arms that rotate and direct wash fluid onto articles in the rack assemblies. Generally, such spray arms are mounted to the spray assemblies using fasteners that extend through the spray arm into other components of the spray assemblies or the tub. In other designs, the spray arms can be secured onto the spray assemblies using snap fit connections. Such snap fit connections can require a bearing that supports the spray arm to be rotated relative to the spray arm in order to secure or engage the snap fit connections.

However, the upper spray assembly is preferably designed to avoid interfering with articles within the rack assembly. In particular, the upper spray assembly's components can be designed such that the upper spray assembly has a thin or narrow profile. Such design constraints can cause difficulty in mounting the upper spray assembly's spray arm with a fastener. Similarly, an assembly worker may have difficulty grasping or rotating the bearing of the spray assembly during manufacture of the dishwasher appliance in order to mount the spray arm to the spray assembly using snap fit features.

Accordingly, a spray assembly for a dishwasher appliance with features for assisting mounting of a spray arm to the spray assembly would be useful. In particular, a spray assembly for a dishwasher appliance with features for permitting a spray arm to rotate a bearing in order to mount of the spray arm to the spray assembly would be useful.

In addition, mounting the upper spray assembly to the tub can be tedious or difficult. Certain upper spray assemblies are mounted to tubs with fasteners such as screws. However, fasteners can strip out and are also labor intensive. Further, securing the upper spray arm to a blow molded conduit that supplies wash fluid to the upper spray arm can be difficult due to the tolerance and geometric limitations of blow molded components.

Accordingly, a spray assembly for a dishwasher appliance with features for assisting mounting of the spray assembly to the dishwasher appliance would be useful. In particular, a spray assembly for a dishwasher appliance with features for assisting mounting of the spray assembly to a blow molded conduit of the dishwasher appliance would be useful.

BRIEF DESCRIPTION OF THE INVENTION

The present subject matter provides a spray assembly for a dishwasher appliance. The spray assembly includes a spray arm, a bearing, and a bracket for mounting the spray assembly to a dishwasher appliance. The spray arm is mounted for rotation relative to the bearing, and the bearing is mounted to the bracket. The spray assembly includes features for rotating the bearing relative to the bracket with the spray arm. Such rotation can assist with mounting of the bearing to the bracket. Additional aspects and advantages of the invention will be set forth in part in the following description, or may be apparent from the description, or may be learned through practice of the invention.

In a first exemplary embodiment, a spray assembly for a dishwasher appliance is provided. The spray assembly defines an axial direction and a radial direction. The spray assembly includes a spray arm that defines an opening and a chamber for receipt of wash fluid from the opening. The spray assembly also includes a bearing. The spray arm is rotatably mounted to the bearing. The bearing includes a conduit that is received within the opening of the spray arm. A plurality of projections is positioned on the conduit and extends outwardly along the radial direction therefrom. A flange is also mounted to the conduit and extends outwardly from the conduit along the radial direction. The flange is positioned within the chamber of the spray arm. A bracket defines an aperture and a plurality of slots. The conduit of the bearing is received within the aperture of the bracket, and each projection of the plurality of projections of the bearing is received within a respective one of the plurality of slots of the bracket. The spray assembly also includes means for selectively rotating the conduit of the bearing within the aperture of the bracket with the spray arm.

In a second exemplary embodiment, a spray assembly for a dishwasher appliance is provided. The spray assembly defines an axial direction and a radial direction. The spray assembly includes a spray arm that defines an opening and a chamber for receipt of wash fluid from the opening. The spray assembly also includes a bearing. The spray arm is rotatably mounted to a bearing. The bearing includes a conduit that is received within the opening of the spray arm. A plurality of projections is positioned on the conduit and extends outwardly along the radial direction therefrom. A flange is also mounted to the conduit and projects from the conduit along the radial direction. The flange is positioned within the chamber of the spray arm. A bracket defines an aperture and a plurality of slots. The conduit of the bearing is received within the aperture of the bracket, and each projection of the plurality of projections of the bearing is received within a respective one of the plurality of slots of the bracket. A support is fixed to the bracket and extends away from the bracket along the axial direction. The support defines a notch that is configured for mounting the spray assembly to a dishwasher appliance.

In a third exemplary embodiment, a method for mounting a spray assembly to a dishwasher appliance is provided. The dishwasher appliance has a tub that defines a wash compartment. The method includes providing: (1) a spray arm that defines an opening and a chamber for receipt of wash fluid from the opening and includes a socket positioned within the chamber; (2) a bearing about which the spray arm is rotatable and that includes a conduit positioned within the opening of the spray arm, a plurality of projections positioned on the conduit and extending therefrom, a flange mounted to the conduit and positioned within the chamber of the spray arm, and a lug mounted to the conduit; and (3) a bracket that defines an aperture, a plurality of channels, and a plurality of slots. The method also includes: securing the bracket to the tub of the dishwasher appliance; positioning the conduit of the bearing within the aperture of the bracket such that each projection of the plurality of projections of the bearing is received within a respective one of the plurality of slots of the bracket; sliding the lug of the bearing into the socket of the spray arm; rotating the spray arm in order to rotate the bearing until each projection of the plurality of projections of the bearing is received within a respective one of the plurality of channels of the bracket; and releasing the spray arm such that the lug of the bearing disengages the socket of the spray arm and the spray arm is rotatable about the bearing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

In FIG. 8, an exemplary embodiment of a spray arm is supported on the bearing of the spray assembly such that an exemplary embodiment of a lug of the bearing is removed from an exemplary embodiment of a socket of the spray arm.

In FIG. 9, the spray arm engages the bearing such that the lug of the bearing is received within the socket of the spray arm in order to permit rotation of the bearing relative to the bracket with the spray arm.

DETAILED DESCRIPTION

Figure 1:
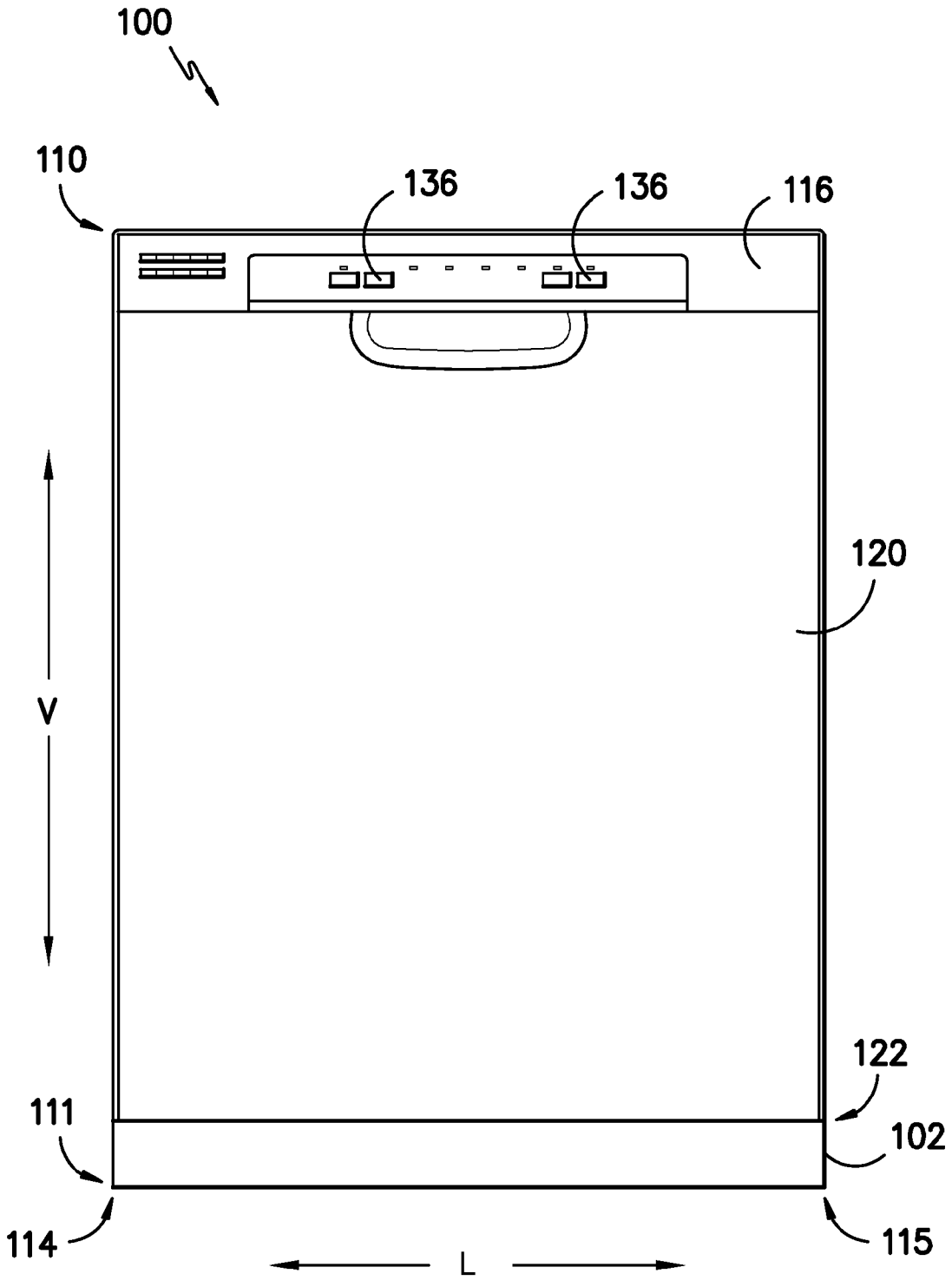
FIG. 1 provides a front elevation view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
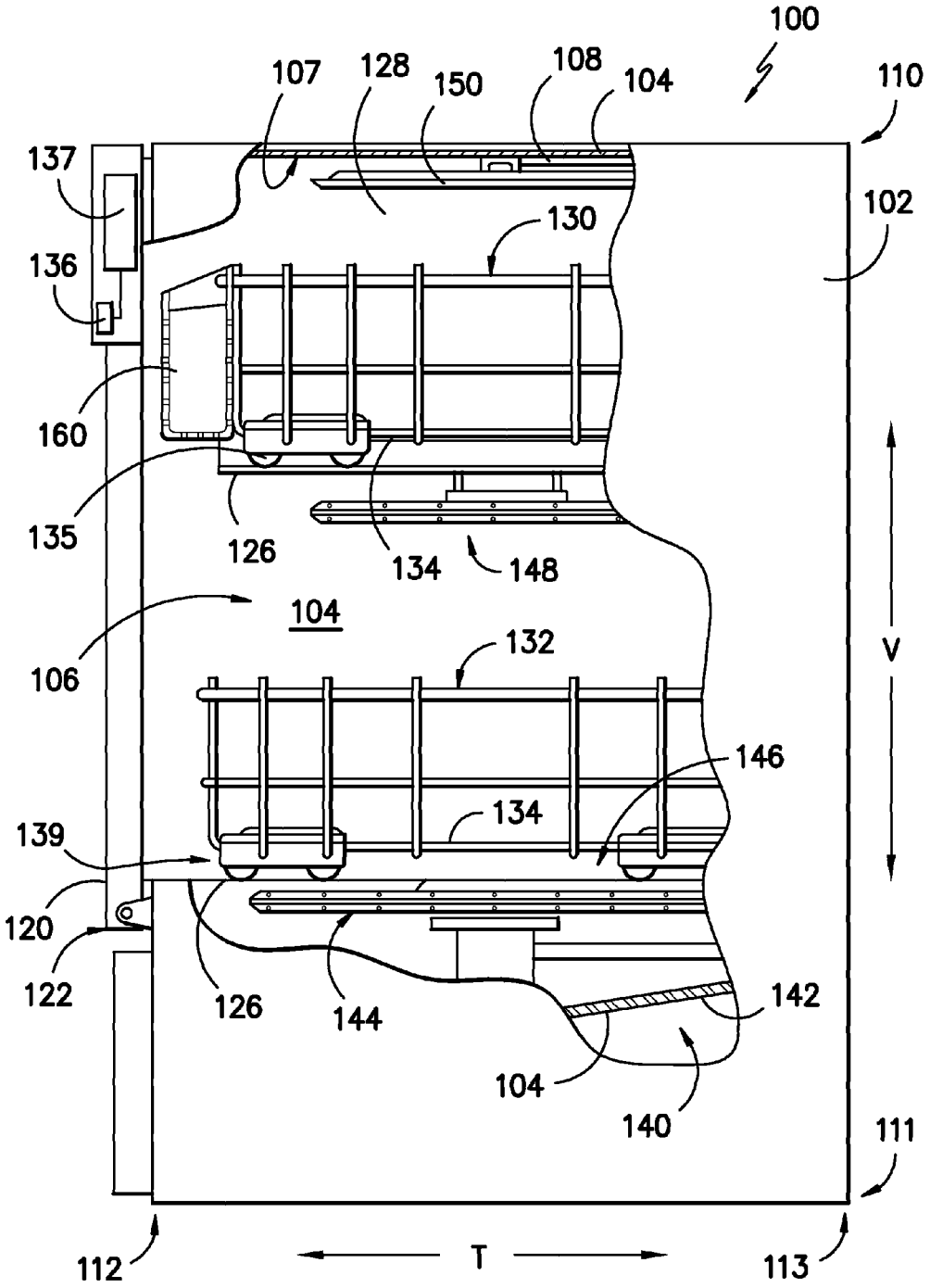
FIG. 2 illustrates a section view of the dishwasher appliance of FIG. 1.

FIGS. 1 and 2 depict a dishwasher appliance 100 according to an exemplary embodiment of the present subject matter. Dishwasher appliance 100 includes a cabinet 102 having a tub 104 therein that defines a wash compartment 106. In particular, tub 104 includes a top wall 107 that assists in defining wash compartment 106. Tub 104 also includes a door 120 hinged at its bottom 122 for movement between a normally closed configuration (shown in FIGS. 1 and 2) in which wash compartment 106 is sealed shut, e.g., for washing operation, and an open configuration, e.g., for loading and unloading of articles from dishwasher appliance 100.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

Turning to FIG. 2, guide rails 126 are mounted on tub side walls 128 and accommodate upper and lower roller-equipped rack assemblies 130, 132. Each of the upper and lower racks 130, 132 is fabricated from lattice structures that include a plurality of elongated members 134. Each rack 130, 132 is adapted for movement between an extended loading position (not shown) in which the rack is substantially positioned outside the wash compartment 106, and a retracted position (shown in FIGS. 1 and 2) in which the rack is located inside the wash compartment 106.

A silverware basket 160 is removably mounted to upper rack assembly 130. However, silverware basket 160 may also be selectively attached to other portions of dishwasher appliance 100, e.g., lower rack 132 or door 120. Silverware rack 160 is configured for receipt of silverware, utensils, and the like, that are too small to be accommodated by the upper and lower racks 130, 132.

The dishwasher appliance 100 further includes a lower spray assembly 144 that is mounted within a lower region 146 of the wash compartment 106 and above a tub sump portion 142 so as to be in relatively close proximity to the lower rack 132. A mid-level spray assembly 148 is located in an upper region of the wash compartment 106 and may be located in close proximity to upper rack 130. Additionally, an upper spray assembly 150 is located above the upper rack 130 and mounted to top wall 107 of tub 104.

The lower and mid-level spray assemblies 144, 148 and the upper spray assembly 150 are fed by a fluid circulation assembly (not shown) for circulating water and wash fluid (e.g., detergent, water, and/or rinse aid) in the tub 104. The fluid circulation assembly may be located in a machinery compartment 140 located below the bottom sump portion 142 of the tub 104, as generally recognized in the art. The fluid circulation assembly includes circulation piping 108 that directs water and/or wash fluid to upper spray assembly 150.

Each spray assembly includes an arrangement of discharge ports or orifices for directing washing liquid onto dishes or other articles located in the upper and lower racks 130, 132 and silverware basket 160. The lower, mid-level spray, and upper assemblies 144, 148, and 150 may be rotatably mounted in wash compartment 106. Accordingly, the arrangement of the discharge ports in at least the lower spray assembly 144 may provide a rotational force by virtue of washing fluid flowing through the discharge ports. The resultant rotation of the lower spray assembly 144 can provide coverage of dishes and other dishwasher contents with a washing spray.

The dishwasher appliance 100 is further equipped with a controller 137 to regulate operation of the dishwasher appliance 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher appliance 100. In the illustrated embodiment, the controller 137 may be located within a control panel 116 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that dishwasher appliance 100 depicted in FIGS. 1 and 2 is provided for illustrative purposes only. For example, the present subject matter may be used in dishwasher appliances having other rack configurations.

Figure 3:
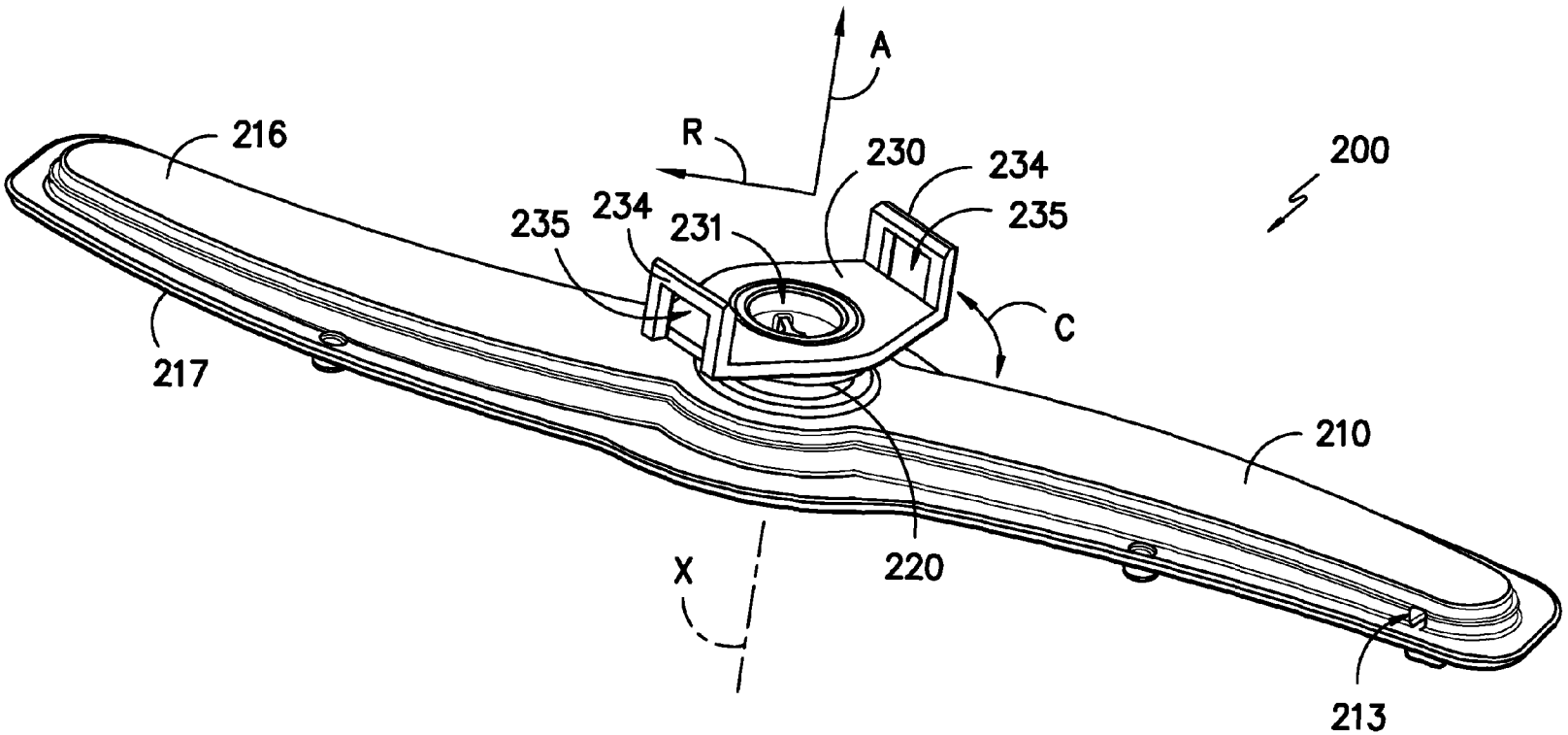
FIG. 3 is a perspective view of a spray assembly according to an exemplary embodiment of the present subject matter and that may be mounted within the dishwasher appliance of FIG. 1.
Figure 4:
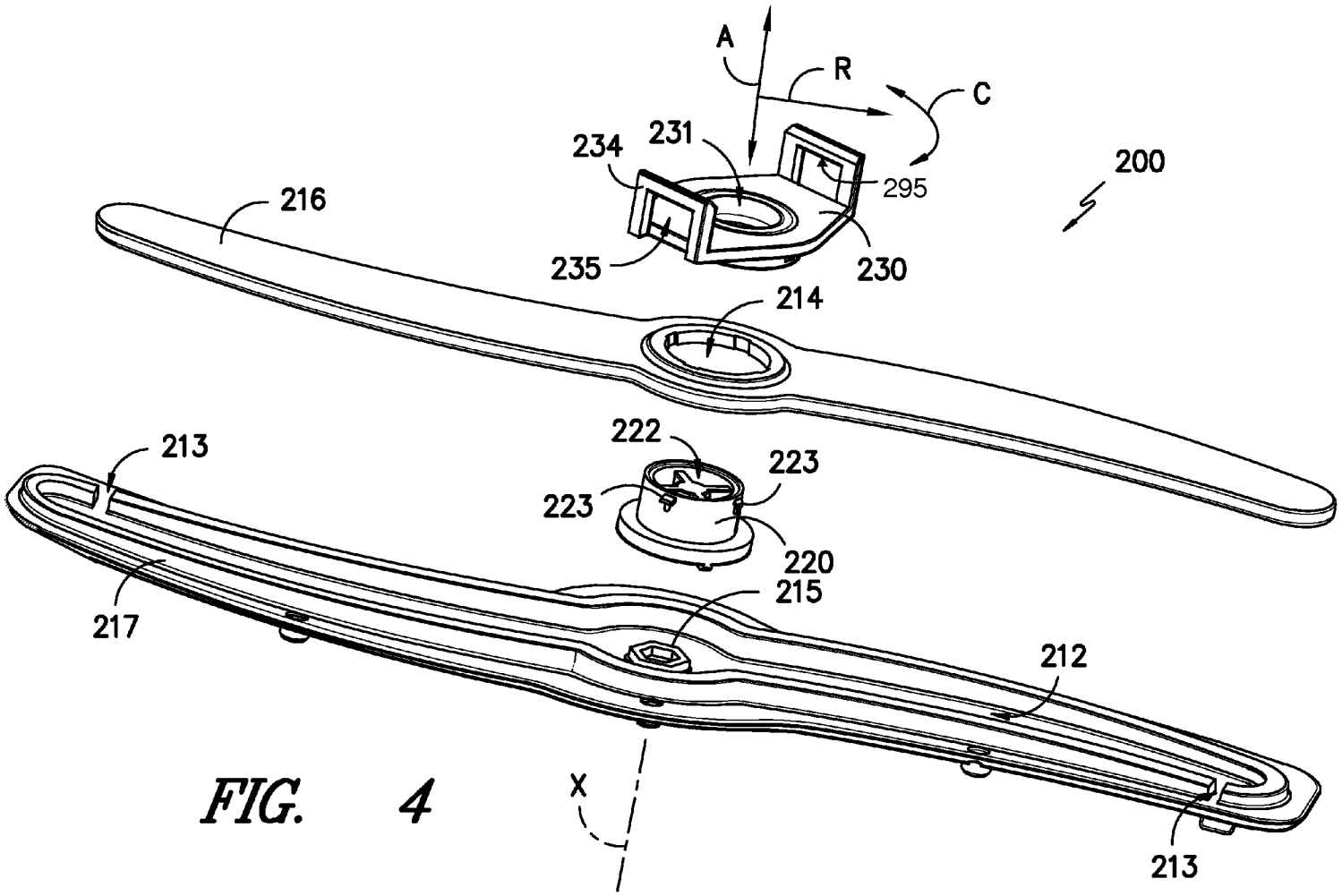
FIG. 4 provides an exploded view of the spray assembly of FIG. 3.

FIG. 3 is a perspective view of a spray assembly 200 according to an exemplary embodiment of the present subject matter. Spray assembly 200 may, e.g., be mounted within wash compartment 106 of dishwasher appliance 100 (FIG. 2). Thus, spray assembly 200 may, e.g., be utilized as upper spray assembly 150, mid-level spray assembly 148 and/or lower spray assembly 144 (FIG. 2). FIG. 4 provides an exploded view of spray assembly 200.

Spray assembly 200 defines an axial direction A, a radial direction R, and a circumferential direction C. Spray assembly 200 includes a bracket 230 that defines an aperture 231. Bracket 230 can be mounted to tub 104 or other components of dishwasher appliance 100 in order to mount spray assembly 200 thereto. As an example, bracket 230 includes supports 234 that may be selectively secured to circulation piping 108 of dishwasher appliance 100 (FIG. 2). In particular, supports 234 define notches 235 that may receive portions of circulation piping 108 in order to mount spray assembly 200 at top wall 107 of tub 104. For example, a bottom surface 295 (FIG. 4) of supports 234 can rest on circulation piping 108 in order to mount spray assembly 200 to tub 107, e.g., to hinder spray assembly 200 from displacing or falling along the vertical direction V (FIG. 2) within tub 104. In particular, supports 234 can snap onto circulation piping 108 and provide an snap fit interface between spray assembly 200 and circulation piping 108.

Spray assembly 200 also includes a bearing 220 mounted to bracket 230. Bearing 220 defines a passage 222 (FIG. 4). Spray assembly 200 further includes a spray arm 210 that is rotatably mounted to bearing 220. Thus, spray arm 210 is mounted for rotation relative to both bearing 220 and bracket 230. Spray arm 210 includes an upper spray arm body 216 and a lower spray arm body 217 that define a chamber 212 (FIG. 4) for receipt of wash fluid therebetween. Upper spray arm body 216 also defines an opening 214 (FIG. 4). Upper and lower spray arm bodies 216 and 217 may be secured together using ultrasonic welding, fasteners, heat staking, solvent bonding, and/or any other suitable technique or method.

As discussed above, chamber 212 of spray arm 210 is configured for receipt of wash fluid during operation of spray assembly 200. As an example, wash fluid may be directed into chamber 212 from circulation piping 108 during operation of dishwasher appliance 100. In particular, aperture 231 of bracket 230 is in fluid communication with circulation piping 108 and receives such wash fluid when bracket 230 is mounted to circulation piping 108. In turn, passage 222 of bearing 220 is in fluid communication with aperture 231 of bracket 230 and receives such wash fluid and directs such wash fluid through opening 214 of spray arm 210 into chamber 212 of spray arm 210. From chamber 212, such wash fluid can exit spray arm 210 through a plurality of nozzles or outlets 213. Nozzles 213 can direct such wash fluid onto articles for washing, e.g., positioned within upper and lower rack assemblies 130 and 132 and/or silverware basket 150 (FIG. 2). Wash fluid exiting nozzles 213 can also urge rotation of spray arm 210 about bearing 220 in order to assist in directing such wash fluid throughout wash compartment 106.

Figure 5:
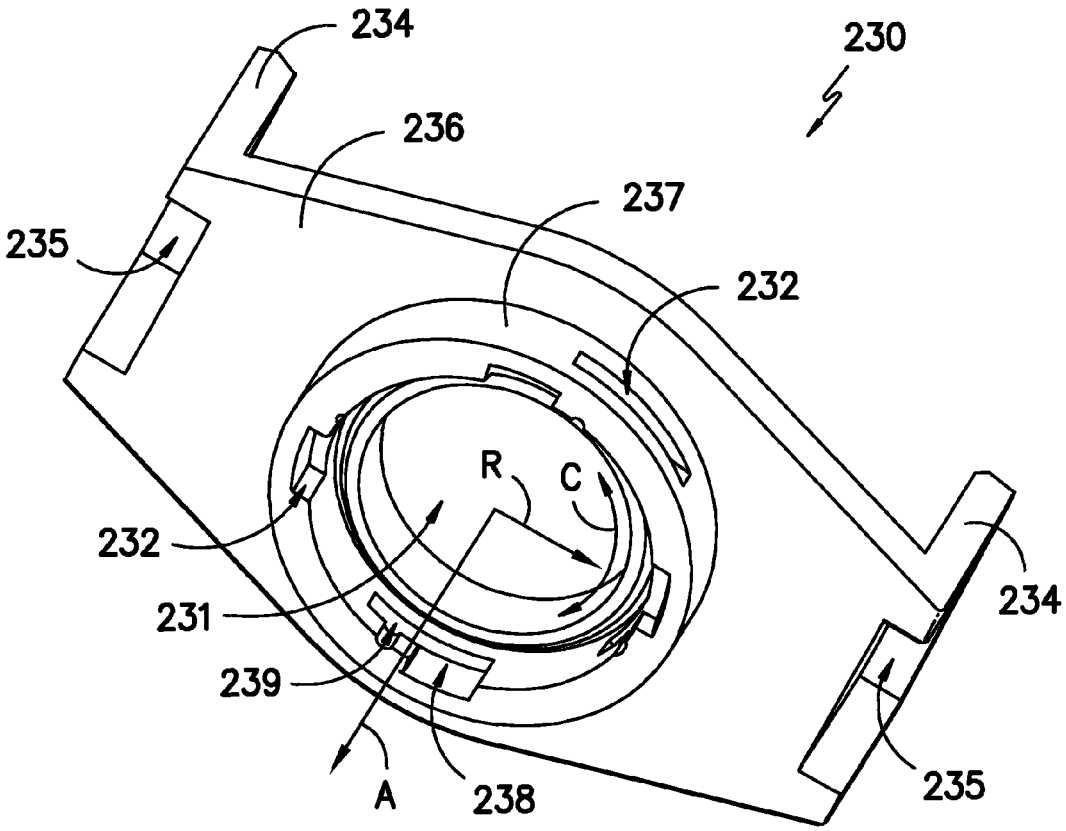
FIG. 5 illustrates a perspective view of a bracket of the spray assembly of FIG. 3 according to an exemplary embodiment of the present subject matter.

FIG. 5 illustrates a perspective view of bracket 230 of spray assembly 200 (FIG. 3) according to an exemplary embodiment of the present subject matter. As may be seen in FIG. 5, bracket 230 includes a plate 236. Supports 234 extend upwardly from plate 236. Supports 234 may extends away from plate 236 by any suitable distance, e.g., along the axial direction A. For example, supports 234 may extends away from plate 236 by less than about one inch, less than about two inches, less than about three inches, or less than about four inches. A circular sidewall 237 extends downwardly from plate 236 along the axial direction A. Thus, supports 234 and circular sidewall 237 are positioned on opposite sides of plate 236. Bracket 230 also defines a plurality of slots 232, e.g., two, three, four, five, or more slots. As an example, plurality of slots 232 may be defined in circular sidewall 237 of bracket 230. Each slot of plurality of slots 232 includes an axial portion 238 that extends along the axial direction A and a circumferential portion or channel 239 that extends along the circumferential direction C. Plurality of slots 232 are configured for assisting with mounting of bearing 220 to bracket 230 as discussed in greater detail below.

Figure 6:
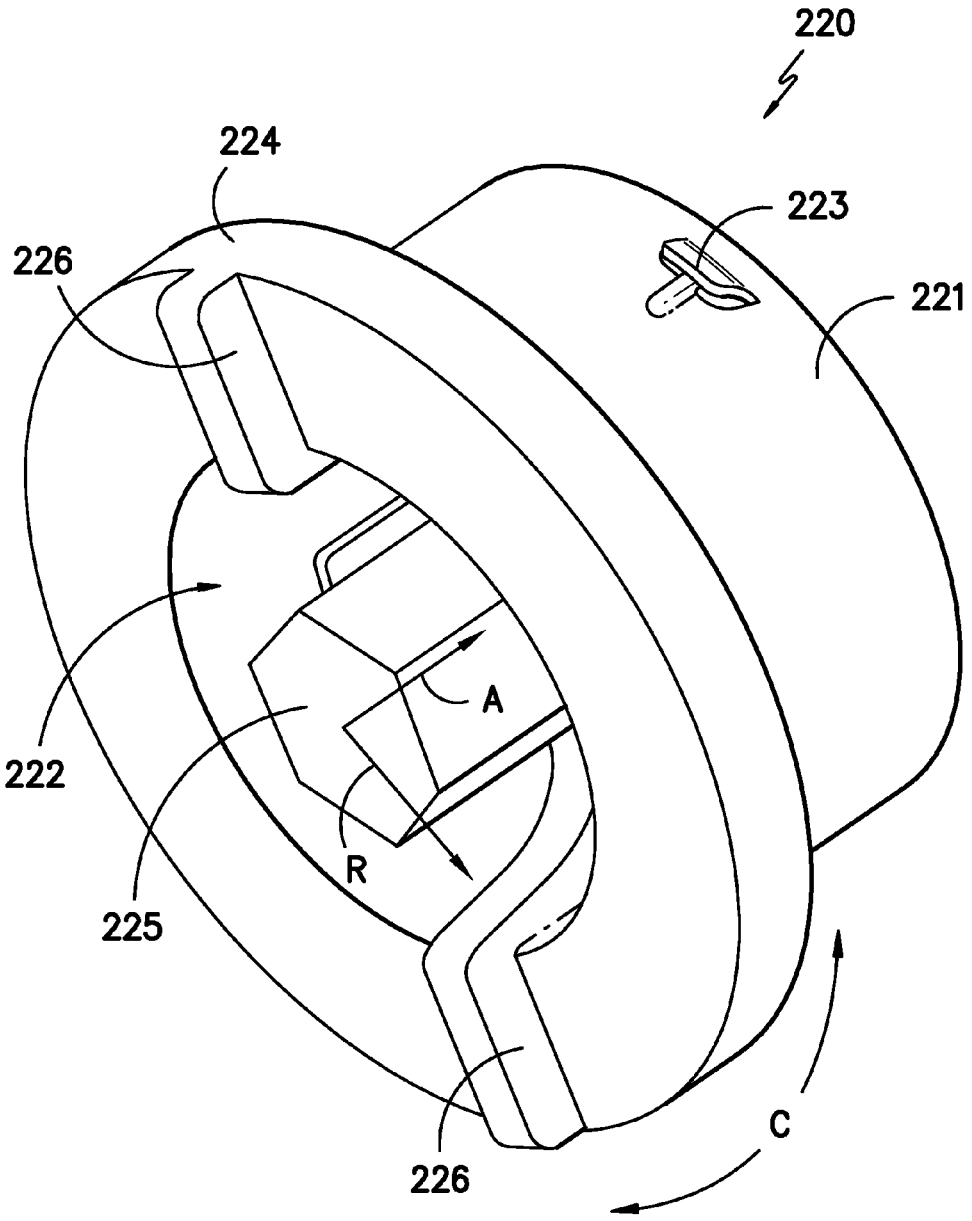
FIG. 6 is a perspective view of a bearing of the spray assembly of FIG. 3 according to an exemplary embodiment of the present subject matter

FIG. 6 is a perspective view of bearing 220 of spray assembly 200 (FIG. 3) according to an exemplary embodiment of the present subject matter. As may be seen in FIG. 6, bearing 220 includes a conduit 221. In the exemplary embodiment shown in FIG. 6, conduit 221 is a hollow cylinder. However, in alternative exemplary embodiments, conduit 221 may have any suitable shape.

Bearing 220 also includes a flange 224 that is mounted to conduit 221. Flange 224 extends outwardly from conduit 221 along the radial direction R. In the exemplary embodiment shown in FIG. 6, flange 224 has an annular shape and, in particular, has a larger diameter than conduit. Bearing 220 further includes a plurality of projections 223, e.g., two, three, four, five, or more projections. Each projection of plurality of projections 223 is positioned on conduit 221 and extends outwardly along the radial direction R therefrom. Flange 224 and plurality of projections 223 are positioned on opposite ends of bearing 220 such that flange 224 and plurality of projections 223 are spaced apart, e.g., along the axial direction A.

Plurality of projections 223 and conduit 221 assist in mounting bearing 220 to bracket 230. In particular, conduit 221 is received within aperture 231 of bracket 230 (FIG. 5) and each projection of plurality of projections 223 is received within a particular slot of plurality of slots 232 of bracket 230 (FIG. 5). In a similar manner, conduit 221 and flange 224 assist in mounting, e.g., rotatably mounting, spray arm 210 (FIG. 3) to bearing 220. In particular, conduit 221 is received within and extends through opening 214 (FIG. 3) of spray arm 210 and flange 224 is disposed within chamber 212 (FIG. 3) of spray arm 210. Because flange 224 has a larger diameter than opening 214, spray arm 210 and bearing 220 are hindered from separating. With spray arm 210 mounted to bearing 220, spray arm 210 can rotate about bearing 220, e.g., during operation of dishwasher appliance 100.

Figure 7:
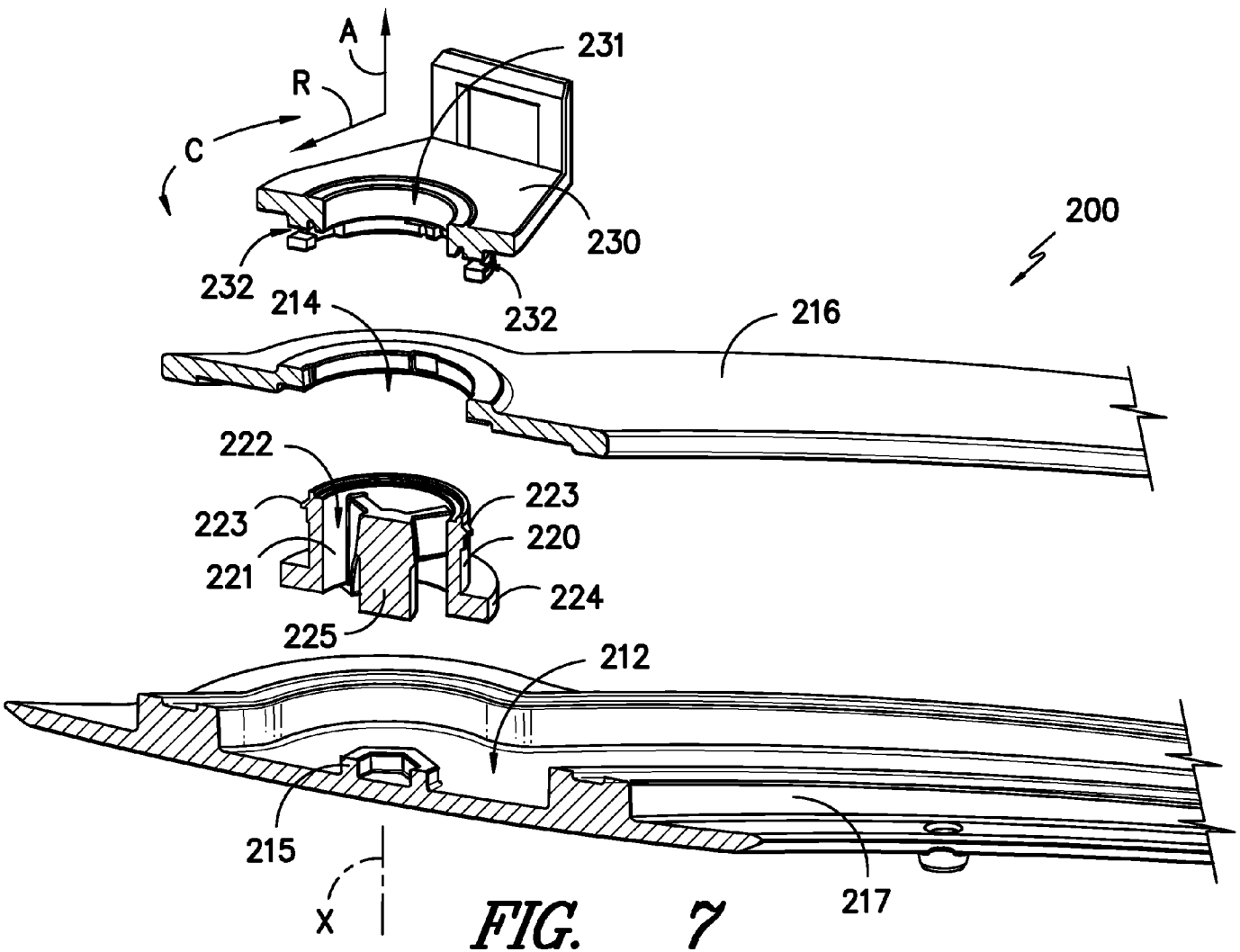
FIG. 7 illustrates an exploded, section view of the spray assembly of FIG. 3.
Figure 8:
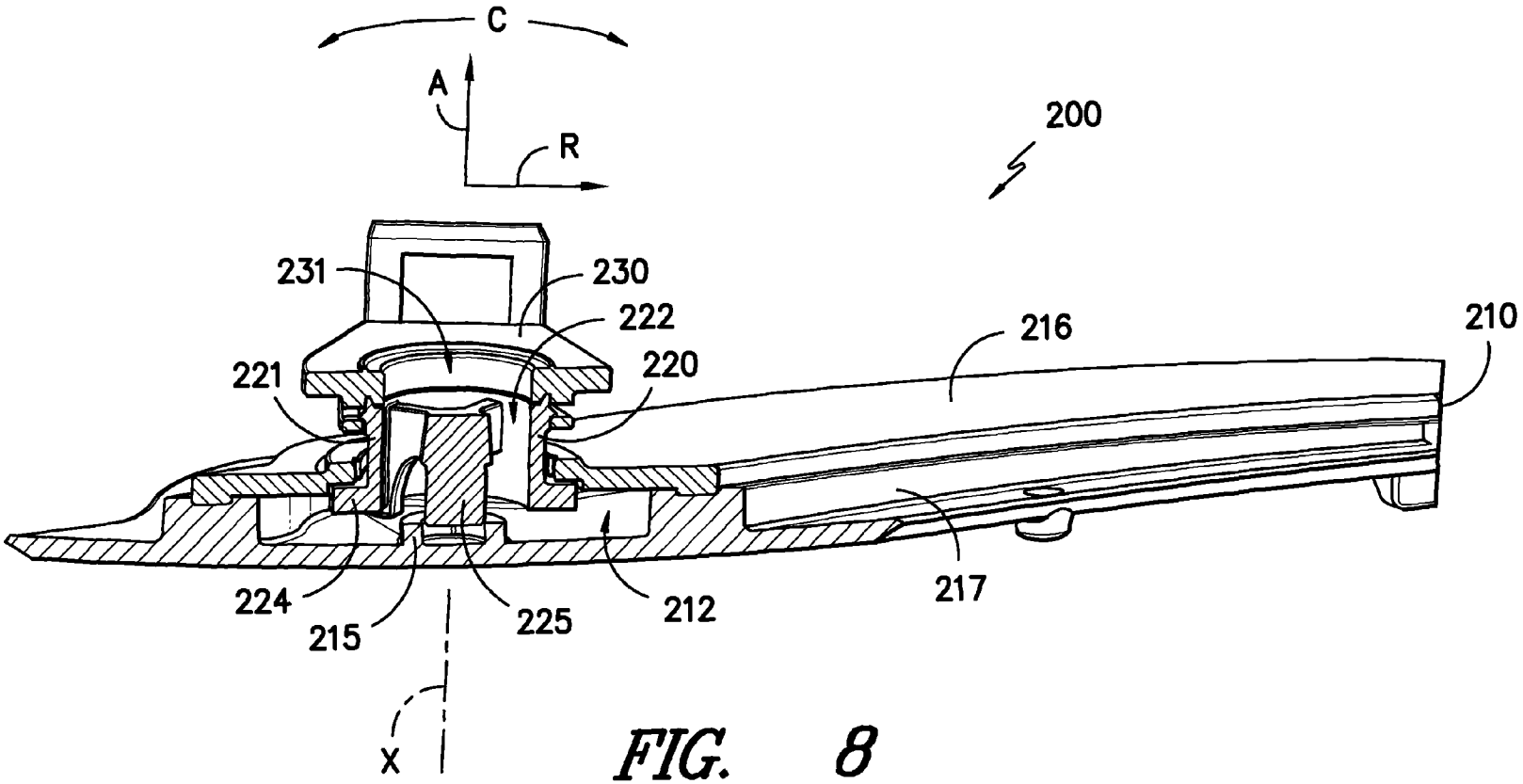
FIG. 8 illustrates a section view of the spray assembly of FIG. 3.

FIG. 7 illustrates an exploded, section view of spray assembly 200. FIG. 8 illustrates a section view of spray assembly 200. As an example, to assemble the spray assembly 200 from the configuration shown in FIG. 7 to the configuration shown in FIG. 8, conduit 221 of bearing 220 may be inserted into opening 214 of spray arm 210 such that flange 224 and plurality of projections 223 are disposed on opposite sides of upper spray arm body 216. Subsequently, upper spray arm body 216 may be mounted or secured to lower spray arm body 217 such that chamber 212 is defined by spray arm 210 with flange 224 disposed therein. Conduit 221 may then be inserted into aperture 231 of bracket 230. During insertion of conduit 221 into aperture 231, plurality of projections 223 may slide into plurality of slots 232, in particular, axial portion 238 (FIG. 5) of plurality of slots 232. To complete mounting of spray arm 210 to bracket 230, conduit 221 is rotated within aperture 231 such that plurality of projections 223 slide into circumferential portion 239 (FIG. 5) of plurality of slots 232.

However, rotating conduit 221 within aperture 231 can be difficult. For example, it can be difficult for a user to grasp conduit 221 or to engage conduit with a wrench or another tool. Thus, spray assembly 200 also includes features for facilitating rotation of conduit 221 within aperture 231. In particular, spray assembly 200 includes a socket 215 positioned within chamber 212 of spray arm 210 and a lug 225 mounted to conduit 221 of bearing 220 in the exemplary embodiment shown in FIGS. 7 and 8. As may be seen in FIG. 8, lug 225 is aligned with socket 215 along the axial direction A. Lug 225 and socket 215 are also positioned on an axis of rotation X of spray arm 210. Further, lug 225 is receivable within socket 215 in order to facilitate or enable rotation of conduit 221 of bearing 220 within aperture 231 of bracket 230 with spray arm 210.

Figure 9:
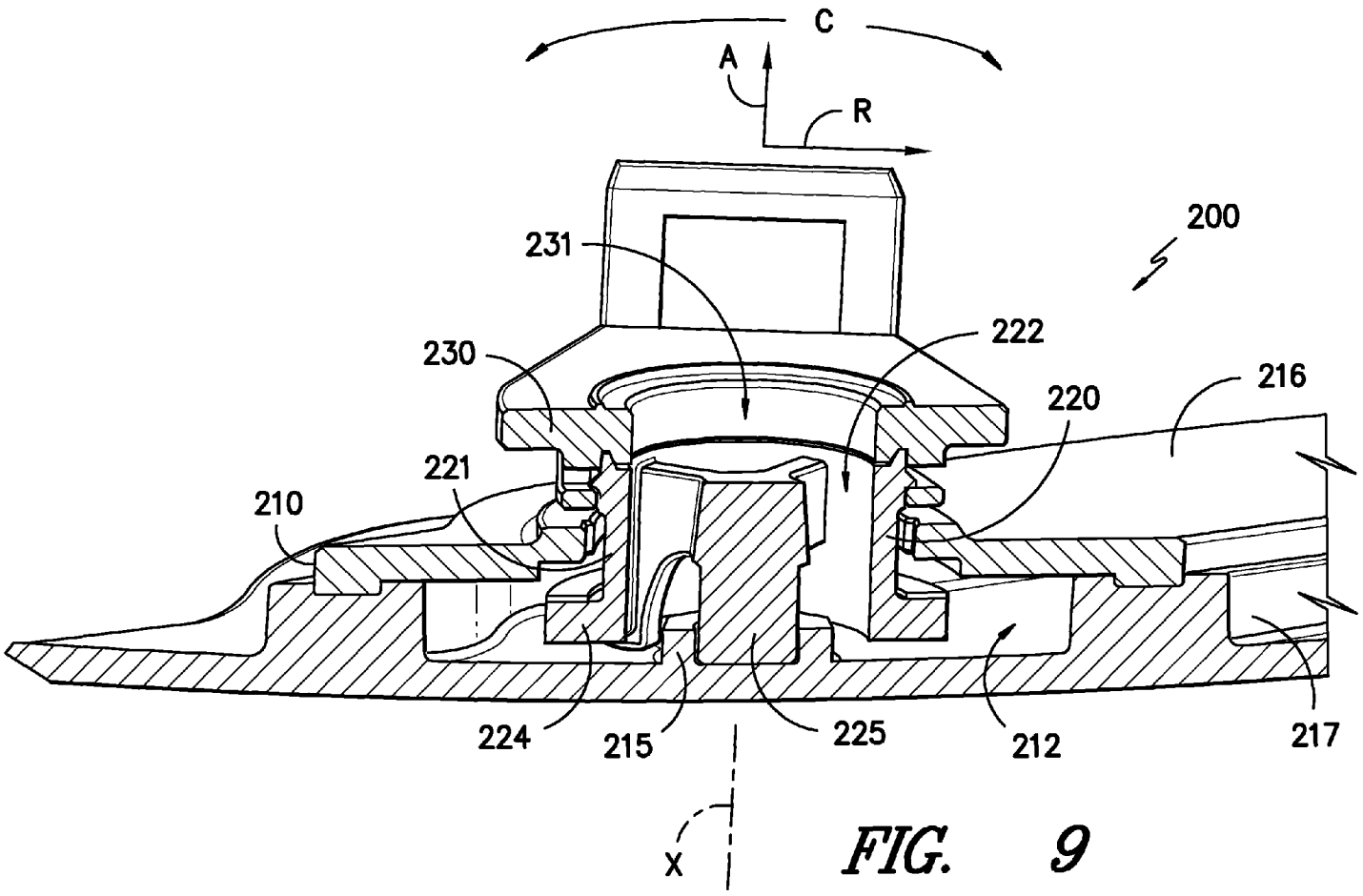
FIG. 9 illustrates a section view of the spray assembly of FIG. 3.

FIG. 9 illustrates a section view of the spray assembly of FIG. 3. In FIG. 9, spray arm 210 engages bearing 220 such that lug 225 is received within socket 215 in order to permit rotation of bearing 220 relative to bracket 230 with spray arm 210, e.g., rotation of conduit 221 of bearing 220 within aperture 231 of bracket 230 with spray arm 210. Conversely, turning back to FIG. 8, spray arm 210 is rotatable about bearing 220 because lug 225 is disposed outside of or removed from socket 215. Thus, spray arm 210 is freely rotatable about bearing 220 in FIG. 8 and locked or coupled to bearing 220 with socket 215 and lug 225 in FIG. 9.

As an example, from the configuration shown in FIG. 8, the spray arm 210 may be lifted upwardly along the axial direction A until lug 225 is disposed or positioned within socket 215. Spray arm 210 may then be rotated in order to rotate bearing 220 relative to bracket 230. In particular, rotation of spray arm 210 can also rotate conduit 221 of bearing 220 within aperture 231 of bracket 230 such that plurality of projections 223 slide into circumferential portion 239 of plurality of slots 232. By sliding plurality of projections 223 into circumferential portion 239 of plurality of slots 232, mounting of spray arm 210 and bearing 220 to bracket 230 can be completed without additional tools and/or requiring grasping of conduit 221.

As best shown in FIG. 6, lug 225 has a hexagonal cross-section in a plane that is perpendicular to the axial direction A. However, in alternative exemplary embodiments, lug 225 may have any suitable cross-section in a plane that is perpendicular to the axial direction A, e.g., oval, triangular, quadrilateral, pentagonal, heptagonal, octagonal, or Phillips head shaped. Also, in alternative exemplary embodiments, lug 225 may be mounted to spray arm 210 and socket 215 may be mounted to bearing 220. Further, alternative mechanisms may be provided to enable rotation of rotation of bearing 220 relative to bracket 230 with spray arm 210. For example, as shown in FIG. 6, bearing 220 includes blades 226 that extend downwardly from flange 224. Blades 226 can engage spray arm 210 in order to enable rotation of rotation of bearing 220 relative to bracket 230 with spray arm 210.

Spray assembly 200 is configured to facilitate mounting of spray assembly 200 within dishwasher appliance 100. As an example, spray assembly 200 may be mounted within dishwasher appliance 100 by securing bracket 230 to tub 104 of dishwasher appliance 100. In particular, bracket 230 may be mounted to circulation piping 108 on top wall 107. Conduit 221 of bearing 220 may then be positioned within aperture 231 of bracket 230. In particular, each projection of plurality of projections 223 may be received within a respective one of plurality of slots 232 of bracket 230, e.g., within axial portion 238 of plurality of slots 232. Lug 225 may then be inserted into socket 215 by lifting or moving spray arm 210 towards bearing 220. With lug 225 disposed within socket 215, spray arm 210 may be rotated in order to rotate bearing 220 until plurality of projections 223 slide within plurality of slots 232, e.g., until plurality of projections 223 is received within circumferential portion 239 of plurality of slots 232. Spray arm 210 may then be released such that lug 225 disengages socket 215 and spray arm 210 is, e.g., freely, rotatable about bearing 220.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A spray assembly for a dishwasher appliance, the spray assembly defining an axial direction and a radial direction, the spray assembly comprising:

a spray arm defining an opening and a chamber for receipt of wash fluid from the opening;

a bearing, said spray arm rotatably mounted to said bearing, said bearing comprising:

a cylindrical conduit received within the opening of said spray arm;

a plurality of projections positioned on the conduit and extending outwardly along the radial direction therefrom; and a flange mounted to the conduit and projecting from the conduit along the radial direction, the flange positioned within the chamber of said spray arm;

a bracket that defines an aperture and a plurality of slots, the conduit of said bearing received within the aperture of said bracket and each projection of the plurality of projections of said bearing received within a respective one of the plurality of slots of said bracket; and means for selectively rotating the conduit of said hearing within the aperture of said bracket with said spray arm.

2. The spray assembly of claim 1, wherein said means for selectively rotating comprises:

a socket positioned within the chamber of said spray arm; and a lug mounted to the conduit of said bearing and aligned with said socket along the axial direction, said lug receivable within said socket in order to enable rotation of the conduit of said bearing within the aperture of said bracket with said spray arm.

3. The spray assembly of claim 2, wherein said lug has a hexagonal cross-section in a plane that is perpendicular to the axial direction.

4. The spray assembly of claim 2, wherein said spray arm comprises an upper spray arm body mounted to a lower spray arm body in order to define the chamber therebetween, the upper spray arm body defining the opening and said socket mounted to the lower spray arm body.

5. The spray assembly of claim 1, wherein said spray assembly defines an axial direction, wherein said means for selectively rotating comprises:

a socket mounted to the conduit of said bearing; and a lug positioned within the chamber of said spray arm and aligned with said socket along the axial direction, said lug receivable within said socket in order to enable rotation of said bearing with said spray arm.

6. The spray assembly of claim 5, wherein said lug has a hexagonal cross-section in a plane that is perpendicular to the axial direction.

7. The spray assembly of claim 5, wherein said spray arm comprises an upper spray arm body mounted to a lower spray arm body in order to define the chamber therebetween, the upper spray arm body defining the opening and said lug mounted to the lower spray arm body.

8. The spray assembly of claim 1, wherein the conduit of said bearing has an annular cross-section in a plane that is perpendicular to the axial direction.

9. The spray assembly of claim 1, wherein said bracket has an outer surface and said spray arm has an outward surface that faces the outer surface of said bracket, the outer surface of said bracket spaced apart from the outward surface of said spray arm by less than about one inch.

10. The spray assembly of claim 1, wherein said spray arm comprises an upper spray arm body mounted to a lower spray arm body in order to define the chamber, the upper spray arm body defining the opening and the lower spray arm body defining a plurality of spray ports for directing wash fluid out of the chamber.

11. A spray assembly for a dishwasher appliance, the spray assembly defining an axial direction and a radial direction, the spray assembly comprising:

a spray arm defining an opening and a chamber for receipt of wash fluid from the opening;

a bearing, said spray arm rotatably mounted to said bearing, said bearing comprising:

a conduit received within the opening of said spray arm;

a plurality of projections positioned on the conduit and projecting along the radial direction therefrom; and a flange mounted to the conduit and projecting from the conduit along the radial direction, the flange being positioned within the chamber of said spray arm;

a bracket defining an aperture and a plurality of slots, the conduit of said hearing received within the aperture of said bracket and each projection of the plurality of projections of said bearing received within a respective one of the plurality of slots of said bracket; and a support fixed to said bracket and extending away from said bracket along the axial direction, the support defining a notch that is configured for mounting the spray assembly to a dishwasher appliance.

12. The spray assembly of claim 11, further comprising means for selectively rotating the conduit of said bearing within the aperture of said bracket with said spray arm.

13. The spray assembly of claim 12, wherein said means for selectively rotating comprises:

a socket positioned within the chamber of said spray arm; and a lug mounted to the conduit of said bearing and aligned with said socket along the axial direction, said lug receivable within said socket in order to enable rotation of the conduit of said bearing within the aperture of said bracket with said spray arm.

14. The spray assembly of claim 13, wherein said lug has a hexagonal cross-section in a plane that is perpendicular to the axial direction.

15. The spray assembly of claim 13, wherein said spray arm comprises an upper spray arm body mounted to a lower spray arm body in order to define the chamber therebetween, the upper spray arm body defining the opening and said socket mounted to the lower spray arm body.

16. The spray assembly of claim 12, wherein said spray assembly defines an axial direction, wherein said means for selectively rotating comprises:

a socket mounted to the conduit of said bearing; and a lug positioned within the chamber of said spray arm and aligned with said socket along the axial direction, said lug receivable within said socket in order to enable rotation of said bearing with said spray arm.

17. The spray assembly of claim 16, wherein said lug has a hexagonal cross-section in a plane that is perpendicular to the axial direction.

18. The spray assembly of claim 16, wherein said spray arm comprises an upper spray arm body mounted to a lower spray arm body in order to define the chamber therebetween, the upper spray arm body defining the opening and said lug mounted to the lower spray arm body.

19. The spray assembly of claim 11, wherein the conduit of said bearing has an annular cross-section in a plane that is perpendicular to the axial direction.

* * * * *